US005495727A

United States Patent [19]

Strong et al.

[11] Patent Number: 5,495,727

[45] Date of Patent: Mar. 5, 1996

[54] CONTAINER AND EXPANDABLE COOLER

[76] Inventors: Bryan Strong, 240 Mississippi Dr.; Nichalous Dahlheimer, 231 E. River St., P.O. Box 254, both of Monticello, Minn. 55362

[21] Appl. No.: 231,312

[22] Filed: Apr. 22, 1994

[51] Int. Cl.[6] ..... B65D 5/00; B65D 5/355; F25D 3/08

[52] U.S. Cl. ..... 62/529; 62/371; 229/101; 229/119; 229/103

[58] Field of Search ..... 62/371, 372, 457.1, 62/457.5, 529, 530; 229/101, 103, 117.02, 119, 901, 910

[56] References Cited

U.S. PATENT DOCUMENTS

| | | | |
|---|---|---|---|
| 415,980 | 11/1889 | Sachs | 62/326 |
| 975,792 | 11/1910 | Pittman | 229/101 |
| 2,791,367 | 5/1957 | Mefford | 229/101 |
| 2,810,506 | 10/1957 | Kessler | 229/101 |
| 2,844,299 | 7/1958 | Kessler et al. | 229/117.22 |
| 2,979,227 | 4/1961 | Norton et al. | 206/169 |
| 3,006,165 | 10/1961 | Mittelberger | 62/371 |
| 3,119,494 | 1/1964 | Rosenstiel | 206/216 |
| 4,328,923 | 5/1982 | Graser | 229/33 |
| 4,706,805 | 11/1987 | Becher | 206/144 |
| 4,777,992 | 10/1988 | Olger | 150/52 |
| 4,858,444 | 8/1989 | Scott | 62/372 |
| 5,020,337 | 6/1991 | Krieg | 62/464 |
| 5,094,359 | 3/1992 | DeMars et al. | 220/462 |
| 5,101,642 | 4/1992 | Alexandrov | 62/372 |
| 5,303,863 | 4/1994 | Arasim | 229/227 |

*Primary Examiner*—Henry Bennett
*Assistant Examiner*—William C. Doerrler
*Attorney, Agent, or Firm*—Mueting, Raasch, Gebhardt & Schwappach

[57] ABSTRACT

A package for packaging individual containers which is expandable to accommodate ice to chill the individual containers. The package includes drain holes which allow for drainage of any fluids which condense on the containers or which leak from the containers during shipment and handling.

16 Claims, 3 Drawing Sheets

CONTAINER AND EXPANDABLE COOLER

FIELD OF THE INVENTION

The present invention relates to the field of packages for packaging a plurality of individual beverage or food containers. More particularly, the present invention relates to a package for packaging a plurality of containers which is expandable to allow for the introduction of ice or other cooling means.

BACKGROUND OF THE INVENTION

The marketing of, for example, beverages such as soda or beer as well as other consumable goods in a plurality of containers which are packaged together is well-known. Typically, beverages are sold in packages of 6, 12, or 24 individual containers which are intended to consumed at a temperature which can be maintained only through the use of ice when no other refrigeration source is available. Consumers are typically required to remove the containers from the package in which they are purchased and place them in a cooler or ice chest to which ice is added to maintain the desired temperature of the product in the containers.

Attempts have been made to provide packages which expand to hold ice and keep beverages or other food commodities in individual containers chilled. U.S. Pat. No. 4,328,923 to Graser describes a carton which is expandable to accommodate ice to keep beverages or other contents chilled. Likewise, U.S. Pat. Nos. 2,844,299 to Kessler et al., U.S. Pat. No. 5,020,337 to Krieg, and U.S. Pat. No. 5,094,359 to DoMars et al. all disclose packages adapted to hold both ice and beverages or other food commodities which are packaged in individual cans or bottles.

All of the above attempts at providing a combination container/cooler fail, however, to incorporate an essential feature of such packages. In particular, none of the disclosed methods or devices of providing a combination package/expandable cooler disclose or suggest the drainage holes necessary to make the packages a viable means of shipping canned products.

In particular, when beverages are contained in aluminum cans, leakage of the product contained therein or of the water which can condense on the containers when chilled must be drained to prevent corrosion which can perforate neighboring cans containing other beverages. If a carton in which the cans are packaged does not provide for drainage, the packages typically cannot be used for shipping due to the corrosion caused by condensation and/or leaking containers. Furthermore, even where perforation of neighboring cans is not an issue, it is desirable to allow for drainage of condensation and/or leaked contents to minimize contamination of the exterior of the other containers in the package. For the above reasons, currently used packages all incorporate drainage holes at the comers of the packages to provide for drainage of liquids which have leaked from containers.

None of the known attempts at providing packages which can also function as coolers provide for the required drainage to make the packages viable for shipping. In fact, each of the prior references described above requires that the containers in the package be located within a waterproof bag or that the inside of the package be lined to provide a waterproof compartment. As a result, any condensation and/or leakage of product from the containers is retained in close proximity with the surrounding beverage containers which would increase the corrosion and perforation of those containers as well as provide ideal conditions for the growth of mold, mildew and bacteria which thrive in humid environments.

SUMMARY OF THE INVENTION

The present invention provides a package for packaging individual containers which is expandable to accommodate ice to chill the individual containers. The package includes drain holes which allow for drainage of any fluids which condense on the containers or which leak from the containers during shipment and handling.

One advantage of the present invention is that it provides a substantially water-resistant package for containing the ice and melt water when placed in particular orientations while also providing drain holes while the package is being shipped in its shipping orientations.

Another advantage of some embodiments of the present invention is that ice introduced into the expanded container will contact at least a portion of each of the individual cans in the container to enhance cooling of each of the cans.

Yet another advantage of the present invention is that the preferred packages can be stacked level on a shipping pallet and remain stable during transport.

These and other advantages and features of the present invention are described with more particularity in the detailed description which refers to the attached drawings.

DETAILED DESCRIPTION OF THE DRAWINGS

DETAILED DESCRIPTION OF THE INVENTION

Figure 1:
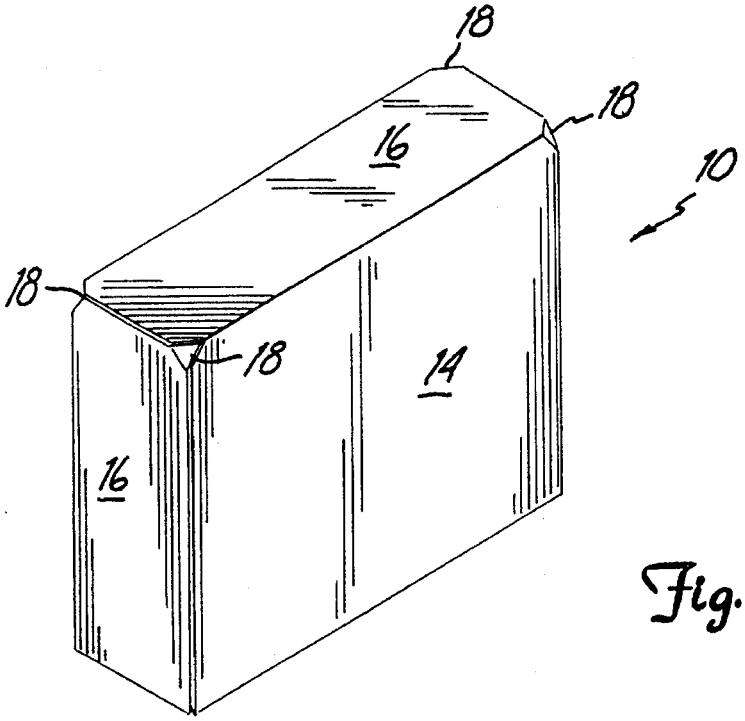
FIG. 1 is a perspective view of a package according to the present invention in its nonexpanded condition.
Figure 2:
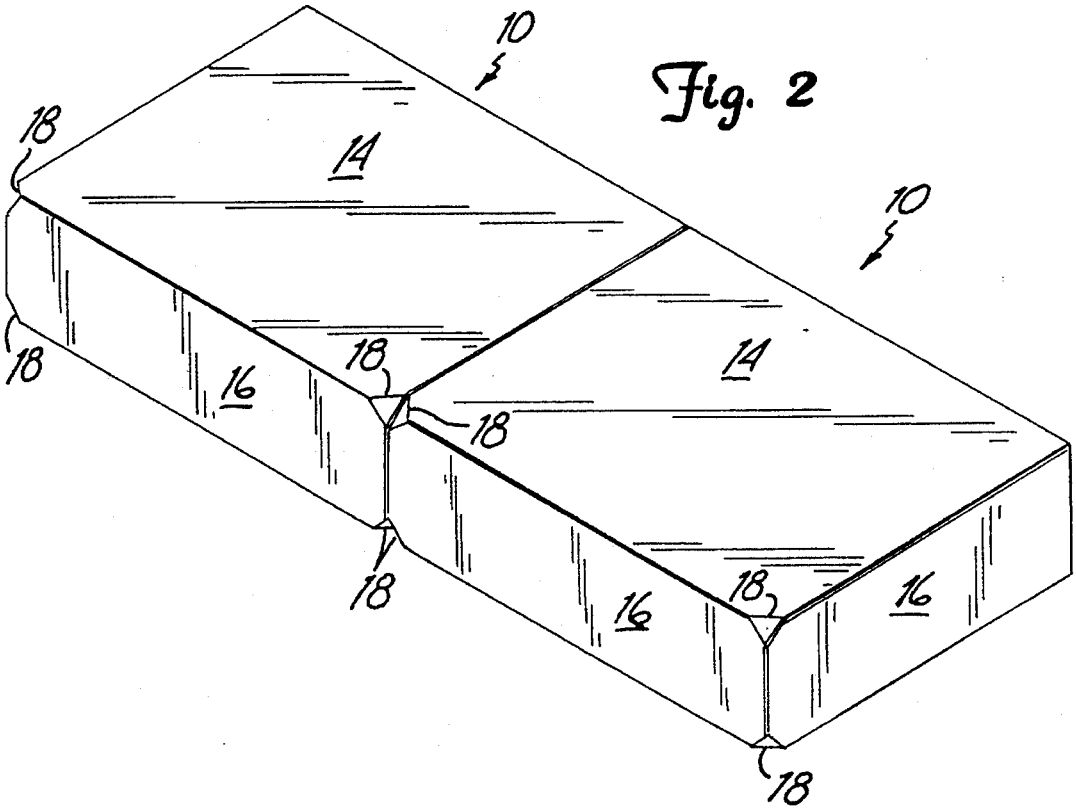
FIG. 2 is a perspective view of two packages according to the present invention in the orientation in which they are stacked for shipping.

Referring now to FIGS. 1 and 2, schematic depictions of the present invention are shown in which package 10 includes major side panels 14, and minor side panels 16. At least one of the minor side panels 16 includes holes or other openings 18 on each of its four comers which preferably extend to the adjacent major side panels 14 and minor side panels 16.

When the packages 10 are stacked for shipping, they are placed on one of the major sides 14 which is the shipping orientation. As a result, the minor side panels 16 are typically located in a vertical orientation. As such, two of the holes or other openings 18 will always be found at the bottom of the package 10 when in a shipping orientation. As a result, if any of the individual containers within the package 10 leak, those fluids can escape from package 10 through drainage openings 18. As described above, drainage is important to prevent the corrosion and perforation of surrounding cans which can came leakage and contaminate the exterior of the surrounding cans.

Typically, the package 10 will be constructed of a paperboard or other similar packaging materials known to those skilled in the art. In particular, the packaging material is preferably suitable for printing a variety of marketing and other information on the exterior or package 10.

Figure 3:
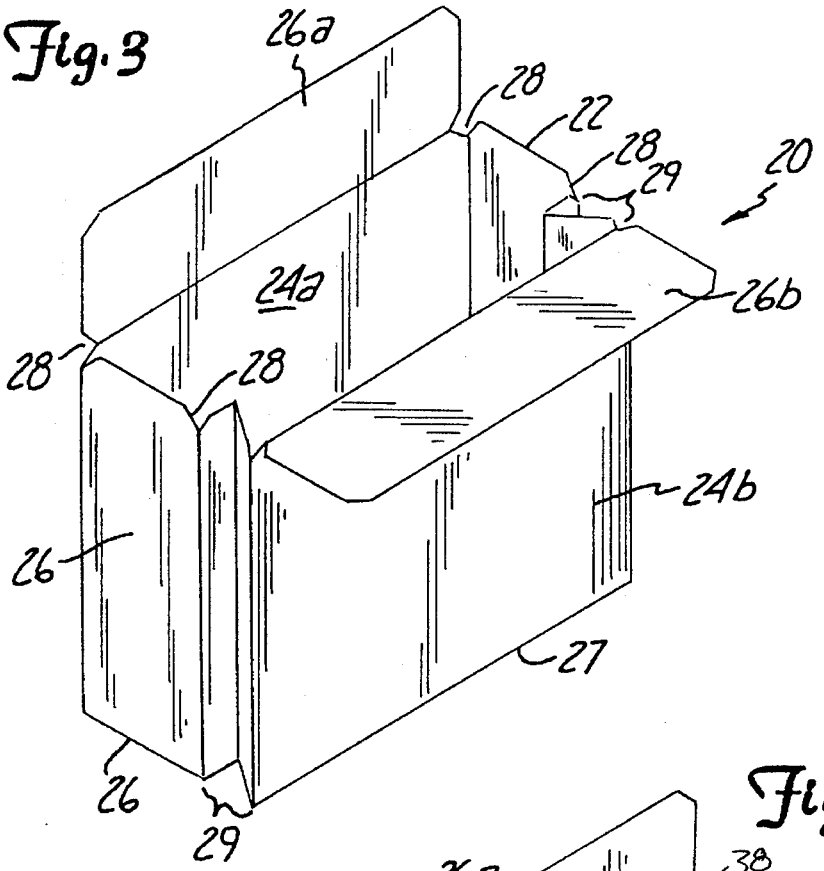
FIG. 3 is a perspective view of one embodiment of the present invention shown in its expanded configuration.

Turning now to FIG. 3, in which one embodiment of a package 20 according to the present invention is depicted in the orientation suitable for use in the expanded configuration. As shown, package 20 includes major side panels 24 and minor side panels 26.

The uppermost minor side panel include two portions, 26*a* and 26*b*, which are held closed during shipping by adhesive or other means known to those skilled in the art. When portions 26*a* and 26*b* are opened as shown, major side panel 24*b* can be expanded outward as shown in FIG. 3. That expansion is provided for by expansion areas 29 incorporated into the design of package 20. Typically, expansion areas 29 will comprise accordion-type folds in the packaging material used to form package 20. As shown, a single accordion fold is provided in package 20, although it will be understood that a multiple number of folds could be incorporated if desired. One advantage of a single fold is the minimization of the stacking height of the package 20 when shipped in its non-expanded configuration in the shipping orientation.

Although not depicted in FIG. 3, it will be understood that an accordion fold is also provided at the bottom or major side panel 24*b* which allows edge 27 of that major side panel to also move outwardly with respect to the panels such as 26 and 22.

In the preferred embodiment, package 20 is lined with a waterproof or water resistant material or coming to provide a means to prevent or substantially reduce leakage of liquids from within package 20 when in its expanded configuration and an orientation suitable for use with notched areas 28 towards the top of package 20 as shown in FIG. 3. In all cases, however, it will be understood that the notches 28 which provide drainage openings in package 20 when in its unexpanded configuration and in the shipping orientation must also remain free of obstructions to allow for drainage when package 20 is in its shipping configuration.

The means for sealing package 20 can include wax or other coatings on the surfaces of major side panels 24 and minor side panels 26. Furthermore, the surfaces of any expansion means such as the accordion folds 29 depicted in FIG. 3 must also be provided as waterproof or water resistant to reduce leakage when ice is placed within the expanded volume of package 20.

Figure 4:
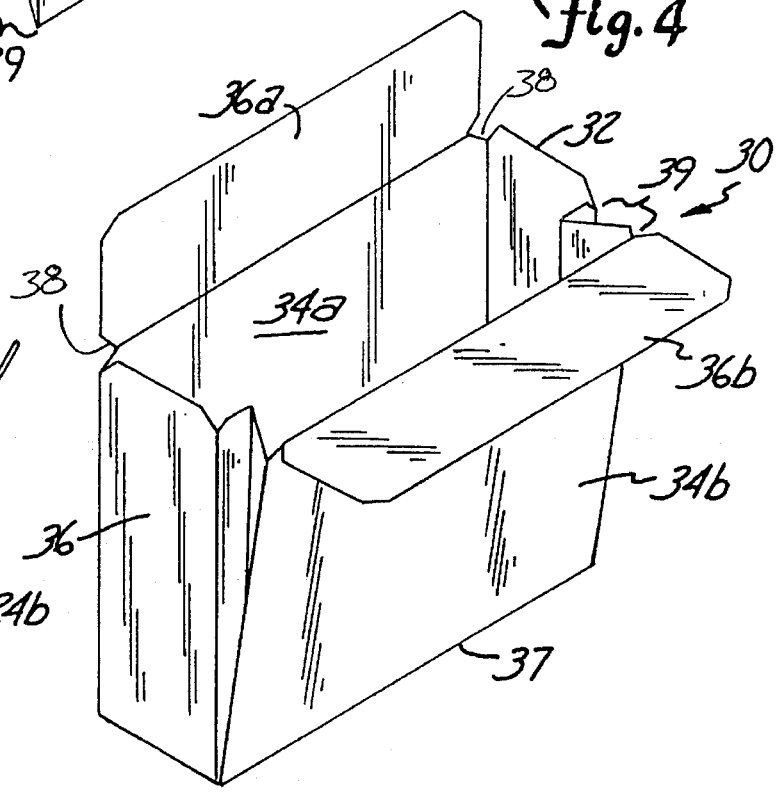
FIG. 4 is a perspective view of an alternate embodiment of the present invention shown in its expanded configuration.

Turning now to FIG. 4, which depicts an alternate embodiment of a package 30 according to the present invention, it will be seen that an alternate expansion means is depicted in which lower edge 37 of major side panel 34*b* remains fixed and provides an axis around which major side panel 34*b* rotates to expand the volume within package 30 using expansion areas 39 depicted in FIG. 4.

Although the embodiments depicted in FIGS. 3 and 4 include only one of the major side panels (14, 24 or 34) which move to expand the package (10, 20, or 30), it will be understood that both major side panels (14, 24, and 34) in the packages (10, 20, or 30) could expand to allow for the introduction of ice into the package to chill the beverage containers located therein.

Figure 5:
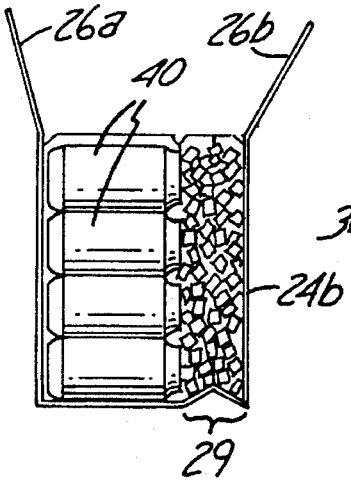
FIG. 5 is a cross section of the container of FIG. 3 showing beverage containers and ice contained within the expanded package.

FIG. 5 depicts a cross-sectional view of package 20 depicted in FIG. 3 which includes containers 40 and ice 42 within the expanded package 20. In this view, the bottom expansion area 29 can be seen which allows major side band 24*b* to move outwardly from the cans 40. In addition, it can be seen in this view that ice 42 is able to contact each of the cans 40 to enhance the heat transfer between the ice 42 and all of the containers 40 in package 20.

Figure 6:
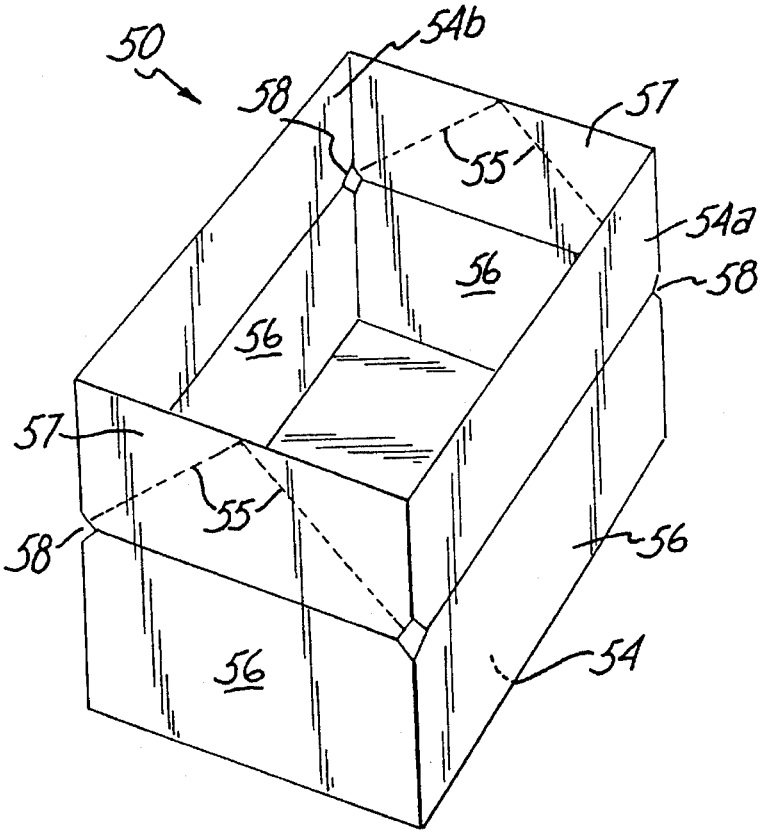
FIG. 6 is a perspective view of an alternate embodiment of a package according to the present invention.

FIG. 6 depicts yet another alternate embodiment of a package 50 in which ice is placed on the exposed individual containers in the package 50. Package 50 includes major side panel 54 and panels 54*a* and 54*b* which combine to form a second major side panel opposite panel 54. Minor side panels 56 connect the two major side panels to form the package 50.

Access to the contents of the package 50 is through the major side panel comprising panels 54*a* and 54*b*. As depicted in FIG. 6, panels 54*a* and 54*b* are connected by panels 57 which include fold lines 55. When panels 54*a* and 54*b* are folded downward into the shipping configuration, thus forming a rectangular-shaped package for shipping, panels 57 are folded inward and lie underneath panels 54*a* and 54*b*.

Openings 58 are provided in each of the comers as shown and provide for the drainage of any leaked product or condensed fluids while package 50 is being shipped. As a result, package 50 must be shipped while lying on any one of the minor side panels 56 or the major side panel formed by panels 54*a* and 54*b* when in the shipping position. In that way, a pair of openings 58 will always lie on the lowest plane occupied by package 50.

Figure 7:
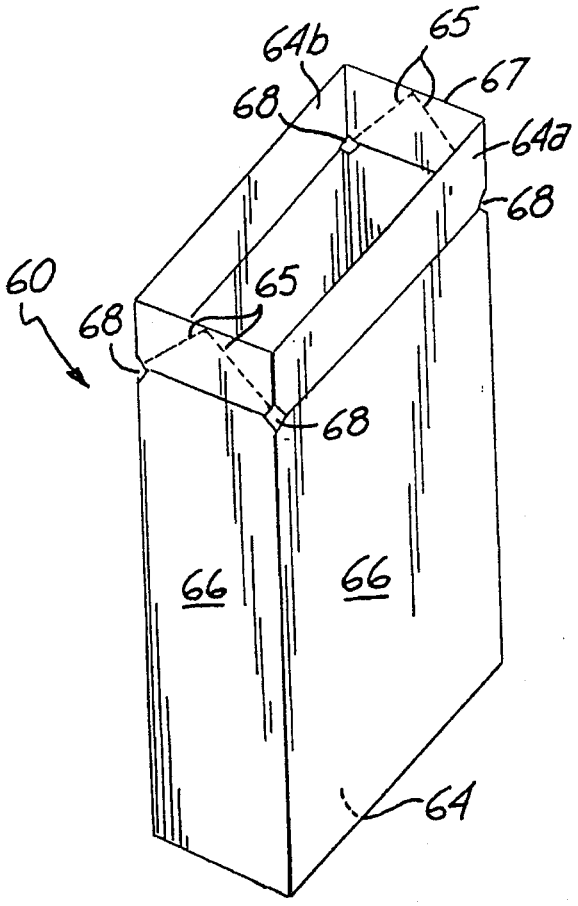
FIG. 7 is a perspective view of an alternate embodiment of a package according to the present invention.

In situations in which the product is purchased chilled, it may be sufficient to place ice only on those containers which will be removed next from the package. To accommodate that situation, FIG. 7 depicts a package 60 in which one of the minor side panels 66 opens similar to the design of package 50. After a container is removed from a package of this design, the ice then falls down through the package 60 to the next containers. In this design, the package 60 can be stacked for shipping on either of its major side panels 64, similar to the packages depicted in FIGS. 1–4.

Like the packages described above in FIGS. 3 and 4, packages 50 and 60 are also preferably lined with a water-resistant or waterproof coating or material to reduce leakage of water as ice placed in the expanded packages melts.

As indicated above, packages according to the present invention can be manufactured from a number of materials. The preferred material is paperboard similar to that used in packages for beer and soda cans, although any formable material with sufficient strength could be substituted. If the material used to construct the packages is itself water-resistant or waterproof, then no additional means of sealing the package may be required.

The actual techniques of constructing packages according to the present invention will follow known methods of forming blanks which are then folded and glued or otherwise secured to provide a finished package of the desired shape. Those details will be well-known to those skilled in the art of constructing packages and will not be further described herein.

In describing the invention above, reference has been made to the illustrated embodiments and advantages of the invention. Those skilled in the art and familiar with the invention may recognize modifications and other changes which will fall within the scope of the invention as described by the following claims.

We claim:

1. A package for packaging a plurality of containers comprising:

a) first and second major side panels spaced apart and substantially parallel to each other;

b) a plurality of minor side panels connecting the first and second major side panels, wherein the minor side panels are located in planes substantially perpendicular to the first and second major side panels, and further wherein the major side panels intersect with each of the minor side panels along edges;

c) a plurality of drainage openings in the package, all of the drainage openings located along the perimeter of one of the major or minor side panels; and d) means for sealing the package to prevent leakage of fluids from the package when the plurality of drainage openings lie above the lowermost plane occupied by the package.

2. A package according to claim 1, further comprising means for expanding the package to accommodate ice as well as the containers.

3. The package of claim 2, wherein the means for expanding comprises at least one fold along an edge of the first major side panel, the fold connecting the edge of the major side panel to an adjacent minor side panel.

4. The package of claim 2, wherein the means for expanding comprises a fold along each of two opposing edges of the first major side panel, each of the folds connecting the opposing edges of the major side panel to an adjacent minor side panel.

5. The package of claim 2, wherein the means for expanding comprises a fold along each of three edges of the first major side panel, each of the folds connecting each of the edges of the major side panel to an adjacent minor side panel.

6. The package of claim 1, wherein each of the plurality of drainage openings are placed at one of the comers of one of the minor or major side panel around which the drainage openings are located.

7. The package of claim 1, wherein the means for sealing comprises a water-resistant liner contained within the package and partially enclosing the plurality of containers.

8. The package of claim 1, wherein the means for sealing comprises a water-resistant coating on at least one of the major side panels and at least one of the minor side panels.

9. The package of claim 1, wherein the means for sealing comprises forming the major and minor side panels from a water-resistant material.

10. A package for packaging a plurality of containers comprising:

a) first and second major side panels spaced apart and substantially parallel to each other;

b) a plurality of minor side panels connecting the first and second major side panels, wherein the minor side panels are located in planes substantially perpendicular to the first and second major side panels, and further wherein the major side panels intersect with each of the minor side panels along edges;

c) a plurality of drainage openings in the package, one drainage opening located at each of the comers of one of the major or minor side panels;

d) means for expanding the package to accommodate ice as well as the containers; and e) means for sealing the package to prevent leakage of fluids from the package when the plurality of drainage openings lie above the lowermost plane occupied by the package.

11. The package of claim 10, wherein the means for expanding comprises at least one fold along an edge of the first major side panel, the fold connecting the edge of the major side panel to an adjacent minor side panel.

12. The package of claim 10 wherein the means for expanding comprises a fold along each of two opposing edges of the first major side panel, each of the folds connecting the opposing edges of the major side panel to an adjacent minor side panel.

13. The package of claim 10, wherein the means for expanding comprises a fold along each of three edges of the first major side panel, each of the folds connecting each of the edges of the major side panel to an adjacent minor side panel.

14. The package of claim 10, wherein the means for sealing comprises a water-resistant liner contained within the package and partially enclosing the plurality of containers.

15. The package of claim 10, wherein the means for sealing comprises a water-resistant coating on at least one of the major side panels and at least one of the minor side panels.

16. The package of claim 10, wherein the means for sealing comprises forming the major and minor side panels from a water-resistant material.

* * * * *

UNITED STATES PATENT AND TRADEMARK OFFICE

CERTIFICATE OF CORRECTION

PATENT NO.: 5,495,727
DATED: March 5, 1996
INVENTOR(S): Strong et al.

It is certified that error appears in the above-identified patent and that said Letters Patent is hereby corrected as shown below:

Col. 1, line 32, delete "DoMars" and insert --DeMars--;
Col. 1, line 56, delete "comers" and insert --corners--;
Col. 1, line 61, add --art-- between "prior" and "references";
Col. 2, line 57, delete "comers" and insert --corners--;
Col. 3, line 3, delete "came" and insert --cause--;
Col. 3, line 9, delete "or" and insert --of--;
Col. 3, line 31, delete "or" and insert --of--;
Col. 3, line 36, delete "coming" and insert --coating--;
Col. 4, line 4, delete "band" and insert --panel--;
Col. 4, line 24, delete "comers" and insert --corners--;
Col. 5, line 37, delete "comers" and insert --corners--; and
Col. 6, line 12, delete "comers" and insert --corners--.

Signed and Sealed this

First Day of September, 1998

*Attest:*

*Attesting Officer*

BRUCE LEHMAN

*Commissioner of Patents and Trademarks*